US005095469A

United States Patent [19]

Leuenberger et al.

[11] Patent Number: 5,095,469

[45] Date of Patent: Mar. 10, 1992

[54] ELECTRONIC WATCH WITH ANALOG TIME DISPLAY

[75] Inventors: Claude-Eric Leuenberger, Geneve-Acacias; Jean-Jacques Burri, Petit-Lancy, both of Switzerland

[73] Assignee: Montres Rolex S.A., Geneva, Switzerland

[21] Appl. No.: 340,472

[22] Filed: Apr. 19, 1989

[30] Foreign Application Priority Data

Apr. 19, 1988 [CH] Switzerland ..... 01441/88

[51] Int. Cl.[5] ..... G04B 17/00; G04C 9/00

[52] U.S. Cl. ..... 368/76; 368/187; 368/321

[58] Field of Search ..... 368/69–74, 368/76, 80, 185–187, 319–321

[56] References Cited

U.S. PATENT DOCUMENTS

| | | | |
|---|---|---|---|
| 4,185,453 | 1/1980 | Jaunin | 368/187 |
| 4,344,761 | 8/1982 | Wakai | 368/69 |
| 4,358,837 | 11/1982 | Yamazaki et al. | 368/187 |
| 4,470,707 | 9/1984 | Caambon et al. | 368/74 |
| 4,600,316 | 7/1986 | Besson | 368/187 |
| 4,620,797 | 11/1986 | Besson et al. | 368/21 |

*Primary Examiner*—Vit W. Miska
*Attorney, Agent, or Firm*—Sandler, Greenblum, & Bernstein

[57] ABSTRACT

An electronic watch having an electronic circuit arranged to control at least one function of the watch other than the usual functions of time indication, in which the manipulation of a time-setting rod and/or the position of movable elements of the watch at a given moment define the parameters which, alone or in combination, correspond to access codes which are recognized by the electronic circuit for accessing the advanced features. The present invention proposes to control the advanced features of the watch by means of a single time-setting rod. The time-setting rod of the preferred embodiment detects four parameters for determining an entered access code. These parameters are: (1) the position of the time-setting rod; (2) the rotation of the time-setting rod; (3) the direction of rotation of the time-setting rod; and (4) the rotation velocity of the time-setting rod.

These four parameters, taken individually or in combination, can define access codes for the various features of the watch using a single control.

11 Claims, 3 Drawing Sheets

ELECTRONIC WATCH WITH ANALOG TIME DISPLAY

BACKGROUND OF THE INVENTION

1. Field of the Invention

The present invention relates to an electronic watch with analogical time display, including at least one hour hand and one minute hand, and optionally at least one movable indicator element, at least one motor to drive the movable elements, as well as an electronic circuit synchronized by a quartz crystal to control the motor, the watch being equipped with a time-setting rod including at least two axial positions.

2. Discussion of Background and Relevant Information

Advancements in micro-electronic timepieces, such as clocks and watches, have permitted the creation of more powerful and complicated timepieces that offer a greater number of functions as compared to watches that were produced in the past. For instance, today's electronic watches may include some or all of the following features: stop-watch functions, chimes, parking meter monitoring, dual time zone display, a calculator, reminder alarm, telephone book and/or dialer, among other features. These features are usually controlled by the use of a plurality of control knobs and a complex liquid crystal display, which can seriously compromise the aesthetics of the watch.

SUMMARY OF THE INVENTION

Accordingly an object of the present invention is to provide an electronic timepiece which takes advantage of the technological advancements in electronic timepieces while preserving the traditional appearance of previous timepieces.

An advantage of the present invention is that a single time-setting rod is provided for controlling the advanced features of the timepiece, thus simplifying the use of the timepiece by its owner.

Another advantage of the present invention is that certain relatively infrequently used setting features can be hidden from the user, reducing the likelihood that the owner will incorrectly initialize the advanced features of the timepiece.

Accordingly, the present invention includes an electronic watch having an electronic circuit arranged to control at least one function of the watch other than the usual functions of time indication, in which the manipulation of a time-setting rod and/or the position of movable elements of the watch at a given moment define the parameters which, alone or in combination, correspond to access codes which are recognized by the electronic circuit for accessing the advanced features. The present invention proposes to control the advanced features of the watch by means of a single time-setting rod. The time-setting rod of the preferred embodiment detects four parameters for determining an entered access code. These parameters are: (1) the position of the time-setting rod; (2) the rotation of the time-setting rod; (3) the direction of rotation of the time-setting rod; and (4) the rotation velocity of the time-setting rod.

These four parameters, taken individually or in combination, can define access codes for the various features of the watch using a single control.

BRIEF DESCRIPTION OF THE DRAWINGS

The foregoing and other objects, features, and advantages of the invention will be apparent from the following more particular description of a preferred embodiment as illustrated in the accompanying drawings in which reference characters refer to the same parts throughout the various views. The drawings are not necessarily to scale, emphasis instead being placed upon illustrating the principles of the invention.

DETAILED DESCRIPTION OF THE PREFERRED EMBODIMENT

Figure 1:
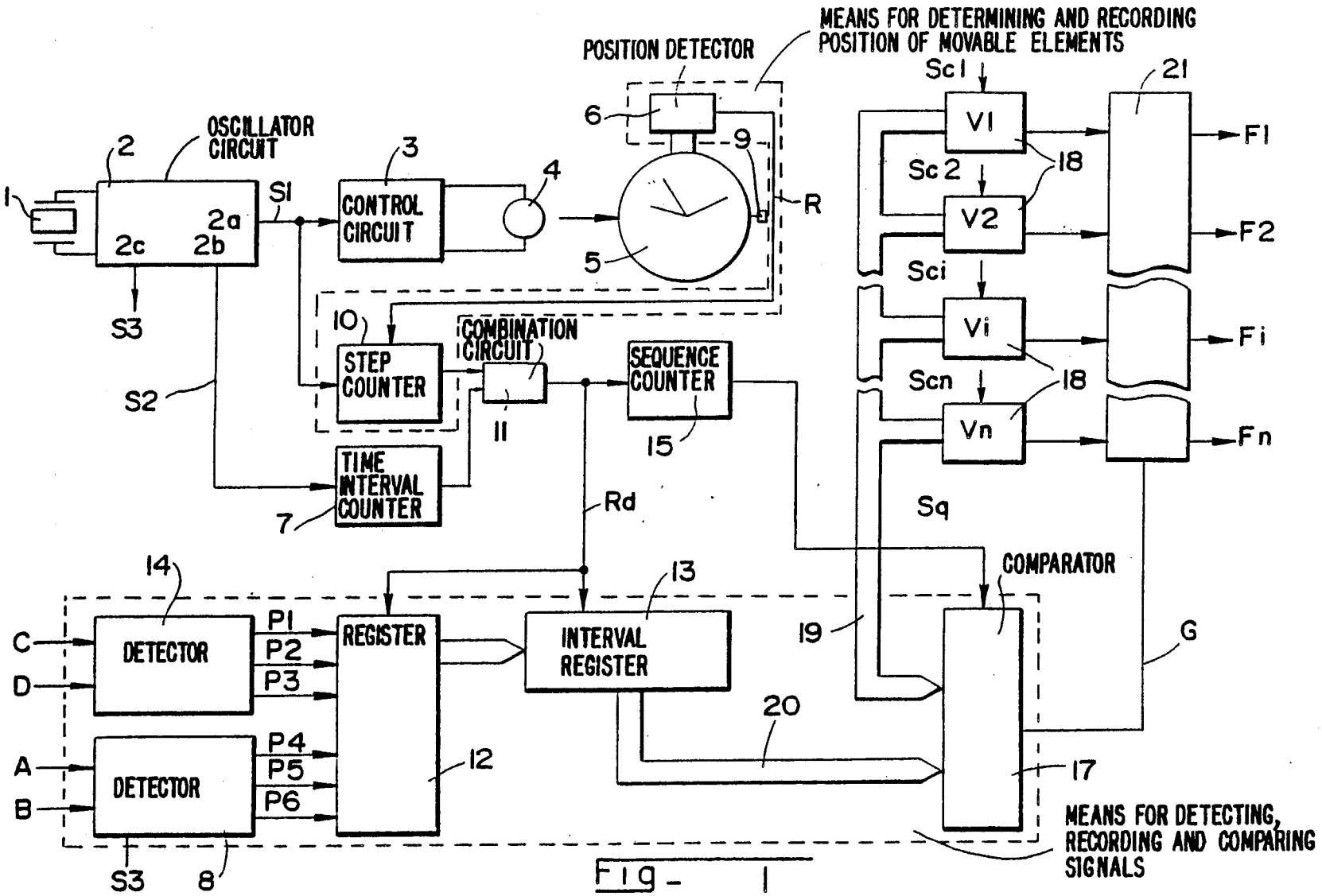
FIG. 1 illustrates a mechanical diagram illustrating the principal components of a preferred embodiment of an electronic timepiece according to the invention.

FIG. 1 illustrates an electronic timepiece, such as a wristwatch 100, of a preferred embodiment of the present invention that contains circuitry which permits the implementation of various advanced features in addition to the conventional function of displaying time. In the past, external control knobs present on the watch housing activated these advanced features. Features common to conventional quartz crystal watches are known by those skilled in the art and are thus not discussed herein.

The watch 100 has a quartz crystal resonator 1 that is coupled to an oscillator circuit 2 that divides the frequency of the crystal 1 into three signals $S_1$, $S_2$ and $S_3$ that are provided to three outputs 2*a*, 2*b* and 2*c*, respectively, of the oscillator circuit 2. Clock signal $S_1$ is transmitted to control circuit 3 to operate a motor 4 so as to drive movable elements, such as hands, discs, etc., on face 5 of the watch 100. Clock signal $S_2$ is transmitted to a time interval counter 7. Clock signal $S_3$ is transmitted to a means for detecting rotation of a crown 9, such as a rotation detection circuit 8.

The crown 9 is connected to a means for accessing a feature, such as a time-setting rod 36 which controls the advanced features of the watch 100, in addition to the setting of time that is displayed on the watch. Clock signal $S_1$ is also transmitted to a step counter 10, which counts the movement of the motor 4 so as to memorize the position of the movable elements on the watch face 5. The step counter 10 is further synchronized by position detectors 6, which act as means for determining and recording the position of the movable elements, to produce a signal R to reset the counter 10 to zero. The position detectors 6 are located in the proximity of the face 5 of the watch.

The output of the time interval counter 7 and of the step counter 10 are transmitted to a combination circuit 11 which acts as means for detecting the manipulation of the time setting rod and temporal position of the movable elements, such as the second hand, whose output is coupled to a register 12 and an interval register 13. The register 12 is designed to receive a series of signals $P_1$, $P_2$ and $P_3$ from a detector 14 and a series of signals $P_4$, $P_5$, $P_6$ from the detector 8. The signals $P_1$, $P_2$ and $P_3$ provide information on the axial position of the crown 9 via signals carried on conductors C and D. The signals $P_4$, $P_5$ and $P_6$ provide information on the rotation of the crown 9 via signals carried on conductors A and B. Detector 8 is connected via the conductors A and B to a first contactor 30, to be discussed below. Similarly, detector 14 is connected via conductors C and D to a second contacting mechanism 32, which will be discussed below.

The interval register 13 is coupled to the output of the register 12 and carries out a staggering of its contents which is equal to the number of parameters of access at each appearance of a reading signal Rd that is transmitted by the combination circuit 11. The reading signal Rd is also transmitted to a sequence counter 15. The detectors 8 and 14, register 12, interval register 13 and comparator 17 form a means for detecting, recording and comparing signals.

The sequence counter 15 outputs a signal Sq to a comparator 17. At each appearance of the signal Sq, the comparator 17 compares the signals on BUS 20, which are transmitted by the interval register 13, to the signals on BUS 19. Various access codes $V_1, V_2, \ldots V_i, \ldots V_n$ are placed in memory 18 of the watch. These access codes are adapted to select corresponding features $F_1, \ldots F_i, \ldots F_n$ of the watch. Each access code $V_1, \ldots V_i, \ldots V_n$ stored in the memory 18 is successively transmitted on the BUS 19 by means of scanning signals $S_{c1}, \ldots S_{ci}, \ldots S_{cn}$, such that at each appearance of the signal Sq, if the BUS 20 generates an access code that exists in the memory 18, the access code is recognized by the comparator 17.

At each recognition of an access code recorded through the detecting means, the comparator 17 generates an output signal G, which is transmitted to a register 21 that contains the features $F_l, \ldots F_i, \ldots F_n$ corresponding, respectively, to the above access codes to execute the selected feature.

Figure 2A:
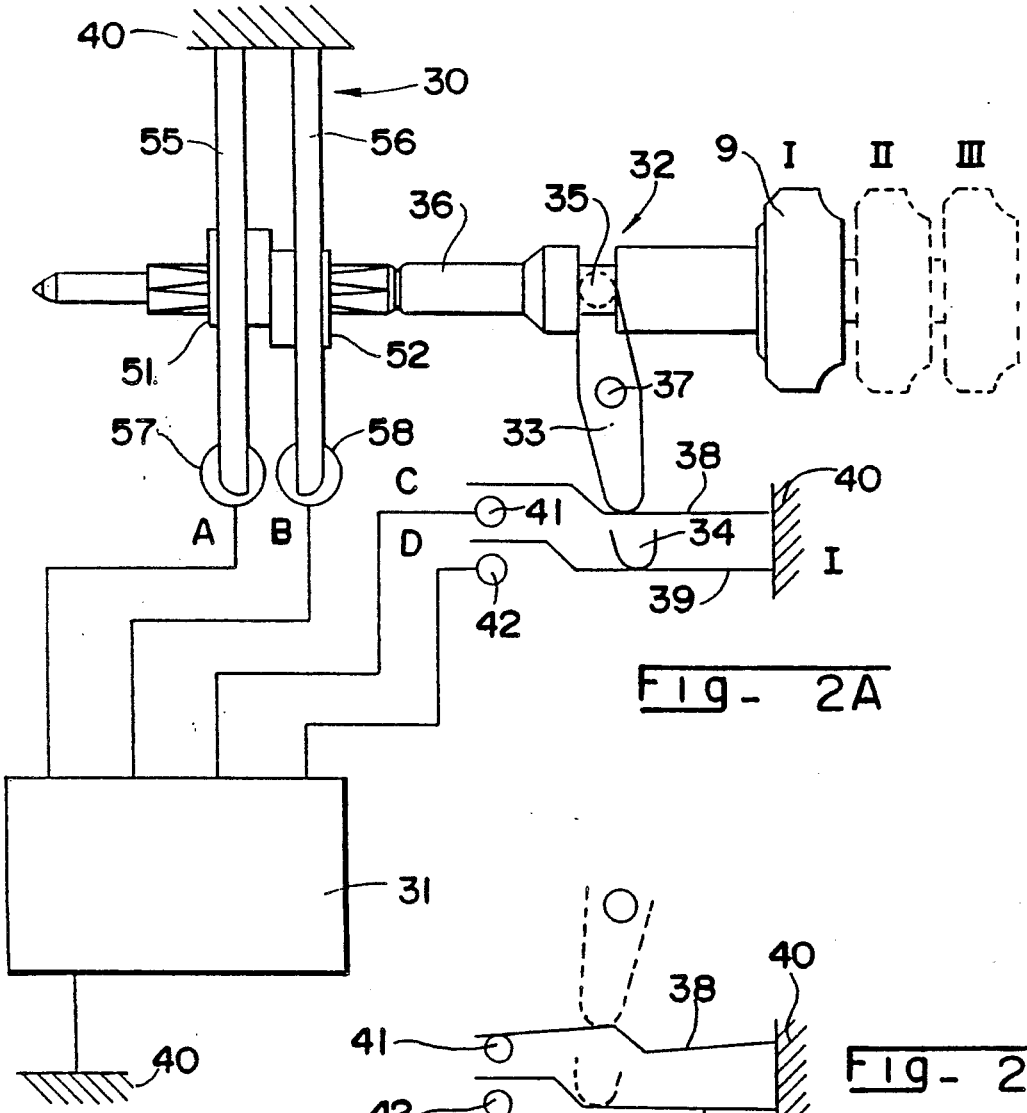
FIG. 2A is a schematic representations of a set of contactors employed in the embodiment of FIG. 1, wherein a time-setting rod that is used to transmit signals that are representative of the axial position of the time-setting rod and of its position in rotation, is shown in a first position.
Figure 2B:
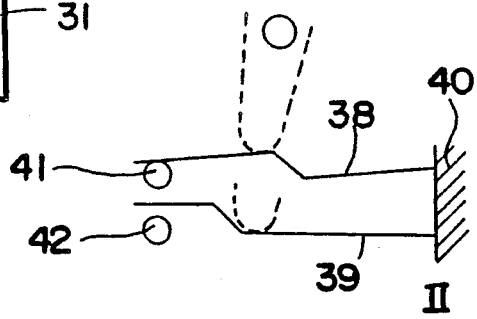
FIG. 2B illustrates the time-setting rod of FIG. 2A in a second position.
Figure 2C:
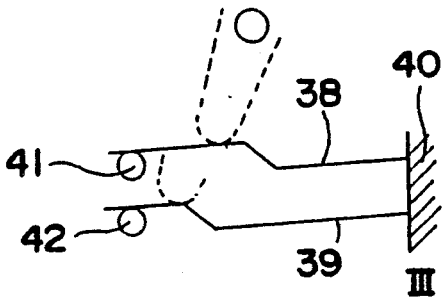
FIG. 2C illustrates the time-setting rod of FIG. 2A in a third position.

FIGS. 2A, 2B and 2C illustrate the operation of the first and second contacting mechanisms 30 and 32 interfaced to the time-setting rod 36 of the watch 100 for transmitting signals that are representative of the axial position and rotation position of the time-setting rod 36. FIGS. 2B and 2C are partial representations of the device of FIG. 2A.

The first contactor 30, viewed from the front and shown in profile in FIG. 2A, is coupled via conductors A and B to the integrated circuit 31 of the watch (which contains the detector 8 shown in FIG. 1). The second contacting mechanism 32 selectively couples spring conductors 38 and 39 to conductors C and D, and hence the integrated circuit 31 (which also contains the detector 14 shown in FIG. 1). Mechanism 32 comprises two pivotable levers 33 and 34 (or, alternatively, one dual lever) which is journaled at 35 on the time-setting rod 36 of the watch 100.

As shown in FIG. 2A, the crown 9 can be positioned at any of three axial positions I, II and III, which correspond to the three positions of the time-setting rod 36. The position of the crown 9 affects the pivoting of the levers 33 and 34 which pivot about an axis 37 and which are adapted to cooperate, respectively, with the two conductors 38 and 39.

As shown in FIG. 2A, wherein the crown 9 is in position I, the two conductors 38 and 39 are in an upper position. That is, the spring conductors 38 and 39 do not touch terminals 41 and 42. Hence, there is an open circuit with respect to the conductors C and D and ground.

When the crown 9 is in position II, as shown in FIG. 2B, conductor 38 moves to a lower position, wherein the conductor 38 touches terminal 41. Hence, a closed circuit exists between conductor C and ground 40. However, the conductor 39 remains in its upper (open circuit) position.

When the crown 9 is in position III, as shown by FIG. 2C, the two conductors 38 and 39 are in their lower position, wherein conductors 38 and 39 touch terminals 41 and 42. Hence, a closed circuit exists between the two conductors C and D and ground 40.

Figure 3A:
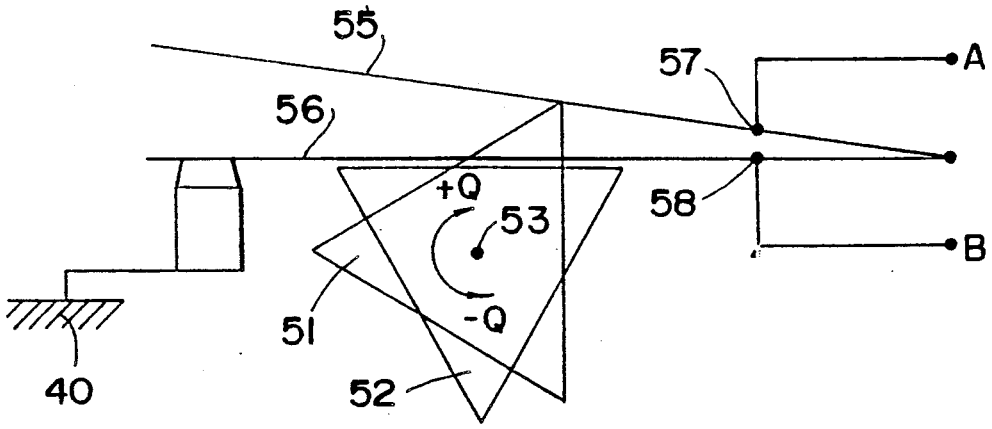
FIG. 3A illustrates a rotation detector used with the preferred embodiment of FIG. 1 to determine the rotation position of the time-setting rod.

The first contacting mechanism 30 comprises two cams 51 and 52 and electrical leaf springs 55 and 56. The two cams 51 and 52 generally take the shape of two rotary equilateral triangles which rotate about an axis 53. As shown in FIG. 3A, the two cams 51 and 52 are offset with each other by approximately 60 degrees. The two cams 51 and 52 act on the two electrical leaf springs 55 and 56, which are designed to selectively close or open a contact between the electrical ground 40 and two contact terminals 57 and 58, which carry signals $U_A$ and $U_B$ in the conductors A and B connected to the integrated circuit 31.

Figure 3B:
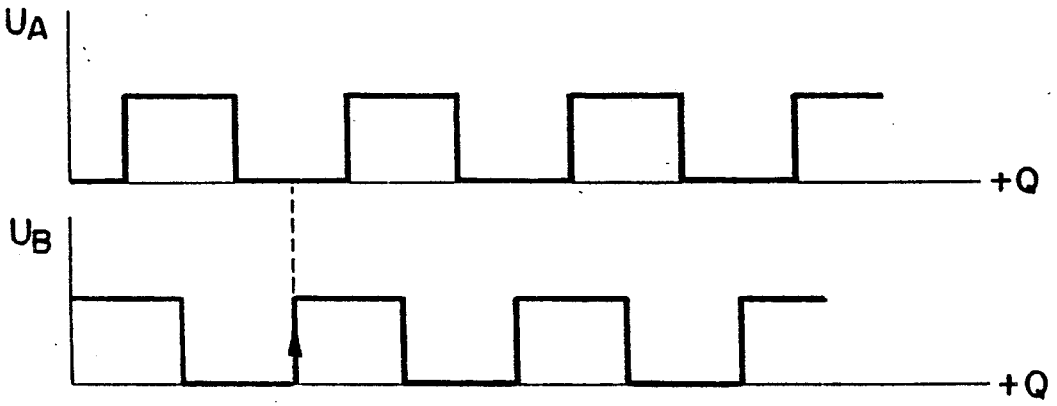
FIGS. 3B and 3C depict digital signals that are generated by the rotation of the time-setting rod of FIG. 2A.
Figure 3C:
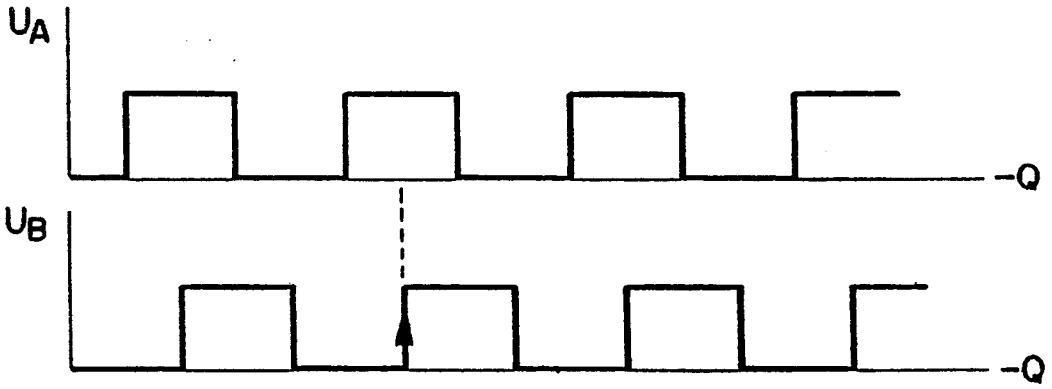

As shown in FIGS. 3B and 3C, the signals $U_A$ and $U_B$ delivered in conductors A and B are cyclical. In the abscissa, there is shown the angular position Q of the cams 51 and 52. In the ordinate, the values of the signals $U_A$ and $U_B$ are shown. The graphs of FIG. 3B and 3C correspond, respectively, to the two directions of rotation +Q and −Q represented by a double arrow in FIG. 3A. It is to be noted that the detectors of axial position and rotation position are known in and of themselves.

Accessing the advanced features of the watch will be described with reference to one advanced feature, namely, the operation of programming a perpetual calendar of the watch. It is to be understood that this operation to access the advanced feature is similar for the other advanced features in the watch.

An access code is provided for gaining access to the programming mode of the perpetual calendar feature of the watch. This is because when the battery in the watch needs replacing, it is also necessary to reset the perpetual calendar. This operation, which is relatively complicated, should preferably be performed only by a trained individual. Accordingly, in this particular case, it is desirable to withhold the resetting procedure from the owner of the watch. Thus, to switch the operation of the watch from its normal operating mode to the programming mode, an access code must be entered. The access code, which is known only by certain persons such as, e.g., a jeweler or a dealer of the watch manufacturer, corresponds to a completely unusual manipulation of the time-setting rod 36. For example, to access the calendar programming mode, a brief rotation in the direction of winding the watch, when the time-setting rod 36 is in the first axial position I, followed by a rotation in the opposite direction when the time-setting rod 36 is brought into the second axial position II, and two successive rotations in the opposite direction, when the time-setting rod 36 is in the third axial position III is performed. This manipulation of the time-setting rod 36 is interpreted by the watch to indicate that it is desired to set the perpetual calendar.

Furthermore, one can likewise relate, either individually or in combination, the entry access code, to the position of movable elements on the watch, such as the hands, discs for the date, day, month, year, lunar phases, etc. These elements can be taken into consideration in an absolute manner in time, i.e., considered as geometric positions with respect to the conventional reference marks of the watch or in a relative manner in time, i.e., considered as intervals of time included between successive geometric positions. Thus, an access code can be used which is related to the axial displacement of the time-setting rod 36, the rotation of the time-setting rod 36, the speed of rotation of the time-setting rod 36, the direction of rotation of the time-setting rod 36, the number of turns of the time-setting rod 36, or temporal data.

The access codes can be based on specific temporal data or on a combination of temporal data and manipulations of the time-setting rod. By way of example, one can provide for a function access code which corresponds to:

- a brief rotation of the time-setting rod 36 in the screwing direction at the passage of the second hand to the 12 o'clock position;
- a waiting period of an interval of time of approximately five seconds; and
- a new rotation in the unscrewing direction at the passage of the second hand at the 1 o'clock position.

In this case, the access code comprises the combination of movable element positions, manipulations of the timesetting rod 36 and of temporal data.

Each access code corresponds to an advanced feature of the watch. As previously mentioned, these different features can include (but are limited to) the indication of a second local time (i.e. "home time" when on vacation); stop-watch functions; chimes; parking time meter expiration alert; time zone indicators; altimeter; diving pressure gauge; a stopwatch for races; an alarm; an appointment reminder; a calculator; a compass; indicating when religious individuals should pray; feature correction; feature programming; feature adjustment; and, feature calibration.

When the feature corresponding to the operating mode of the watch has an interest for the watch wearer, such as a stopwatch function, altimeter, etc., the access code is available for entry by the user. However, when the feature corresponds to a sophisticated function, such as a programming mode, calibration, etc., the access code should be withheld from the general knowledge of the public.

Based on the number of parameters likely to be combined in multiple ways to construct access codes, the number of access codes is virtually unlimited.

While the invention has been particularly shown and described with reference to the preferred embodiment thereof, it will be understood by those skilled in the art that various alterations in form and detail may be made without departing from the spirit and scope of the invention as defined by the following claims.

We claim:

1. An electronic timepiece having movable elements and a motor to drive said movable elements, comprising an electronic circuit that is synchronized by a quartz crystal so as to control said motor, said timepiece having a timesetting rod that is movable between at least two axial positions, said electronic circuit being arranged to control at least one function of said timepiece other than the function of time indication, wherein predetermined manipulations of said time-setting rod of said timepiece, in addition to movement between said axial positions of said time-setting rod, define parameters which correspond to function access codes, said electronic circuit being designed to recognize said access codes to activate said functions that correspond to said access codes, wherein said predetermined manipulations comprise a combination of particular manipulations of said time-setting rod which define a lock against activating said functions corresponding to said function access codes.

2. The timepiece of claim 2, wherein said combination of particular manipulations of said time-setting rod for entering said access codes are performed by changing the axial position of said time-setting rod, the axial displacement of said time-setting rod, the rotation of said time-setting rod, the direction of rotation of said time-setting rod, the velocity of rotation of said time-setting rod, the mode of rotation of said time-setting rod or the number of turns of said time-setting rod.

3. The timepiece of claim 3, wherein said function access codes are further defined by temporal data of said time-setting rod.

4. The timepiece of claim 4, further comprising a means for recording and comparing signals corresponding to said temporal data which is based upon the sequence of displacement of said movable elements, the duration of time that elapses between two displacements of said movable elements, or the duration of displacement of one of said movable elements.

5. An electronic timepiece having movable elements and a motor to drive said movable elements, comprising an electronic circuit that is synchronized by a quartz crystal so as to control said motor, said timepiece having a time-setting rod that is movable between at least two axial positions, said electronic circuit being arranged to control at least one function of said timepiece other than the function of time indication, wherein predetermined manipulations of said time-setting rod of said timepiece, in addition to movement between said axial positions of said time-setting rod, define parameters which correspond to function access codes, said electronic circuit being designed to recognize said access codes to activate said functions that correspond to said access codes, said timepiece further comprising means for determining and recording the position of said movable elements, wherein functions which correspond to said access codes are determined by said position of said movable elements.

6. The timepiece of claim 5, wherein said movable elements comprise an hour hand, a minute hand, a second hand, or a revolving disc for displaying dates, days, months, years, and lunar phases.

7. The timepiece of claim 5, wherein the positions of said movable elements corresponding to said function access codes are absolute positions in time.

8. The timepiece of claim 5, wherein the positions of said movable elements corresponding to said access codes are relative positions in time.

9. The timepiece of claim 5, wherein said functions of said timepiece corresponding to said access codes are intervals of time.

10. The timepiece of claim 1, in which said movable indicator includes a second hand, said timepiece also having a perpetual calendar, wherein one of said access codes corresponds to a particular manipulation of said time-setting rod that comprises a combination of rotations of said time-setting rod and temporal positions of said second hand, and a means for detecting said manipulation of said time-setting and said temporal position of said second hand to activate a programming mode of said perpetual calendar.

11. An electronic timepiece having at least one function in addition to a time-indication function, said timepiece comprising:

movable elements;

means for moving said movable elements;

an electronic circuit for controlling said moving means and for controlling said at least one function in addition to said time-indication function;

a time-setting rod that is movable to and from at least two axial positions, said time-setting rod being manipulable in a manner defined by a plurality of parameters, predetermined sequences of which define a plurality of access codes for enabling said electronic circuit to control said at least one function in addition to said time-indication function; and means for sensing said predetermined sequences of said parameters for identifying said access codes for selectively enabling said electronic circuit to control said at least one function in addition to said time-indication function, wherein said at least one function in addition to said time-indication function comprises a perpetual calendar function, wherein said electronic circuit is enabled to control said perpetual calendar function by the performance of one of said predetermined sequences of said parameters which includes at least a combination of a predetermined rotation of said time-setting rod and a predetermined temporal position of at least one of said movable elements.

* * * * *

UNITED STATES PATENT AND TRADEMARK OFFICE

CERTIFICATE OF CORRECTION

PATENT NO. : 5.095.469

DATED : March 10. 1992

INVENTOR(S) : Claude-Eric LEUENBERGER et al.

BEST AVAILABLE COPY

It is certified that error appears in the above-indentified patent and that said Letters Patent is hereby corrected as shown below:

On the title page, item [56], Reference Cited: "Caambon" should be --Chambon--.

column 3. line 26 of the printed patent after "to" insert ---means for detecting. recording and comparing signals comprising--- column 5. line 35 of the printed patent "timesetting" should be ---time-setting---.

column 6, line 1 (claim 1, line 5) of the printed patent "timesetting" should be ---time-setting---.

Signed and Sealed this

Fourteenth Day of November, 1995

Bruce Lehman

*Attest:*

BRUCE LEHMAN

*Attesting Officer*

*Commissioner of Patents and Trademarks*